United States Patent [19]

Aldag et al.

[11] 3,939,923

[45] Feb. 24, 1976

[54] POWER-DRIVEN IMPACT TOOL HAVING AN IMPACT-RESISTANT HAND GRIP ASSEMBLY

[75] Inventors: Friedrich-Wilhelm Aldag, Meerbusch; Robert Hans Scheipner, Dusseldorf; Helmut Schluessler, Norf, all of Germany

[73] Assignee: Demag Aktiengesellschaft, Duisburg, Germany

[22] Filed: Jan. 17, 1975

[21] Appl. No.: 541,764

[30] Foreign Application Priority Data

Jan. 23, 1974 Germany ..... 2403074

[52] U.S. Cl. ..... 173/162; 175/56; 267/137

[51] Int. Cl.[2] ..... B25D 17/24

[58] Field of Search ..... 173/139, 162; 267/137; 175/56

[56] References Cited

UNITED STATES PATENTS

| | | | |
|---|---|---|---|
| 1,679,291 | 7/1928 | Byers | 173/139 |
| 2,400,650 | 5/1946 | Leavell et al. | 173/162 |
| 2,875,731 | 3/1959 | Settles et al. | 267/137 |
| 3,788,404 | 1/1974 | Koudelka et al. | 173/139 |

*Primary Examiner*—Ernest R. Purser

[57] ABSTRACT

An improved impact-type tool driven by pneumatic or similar power means is provided with a hand grip assembly which is substantially insulated from impact and shaking movements of the drive portion of the tool when the latter is in operation. Both the hand grip assembly and a supplementary weighted ring are disposed coaxially around the tool drive housing and are individually mounted for axial movement with respect thereto. The hand grip assembly is divided into upper and lower chambers by means of an intermediate annular guide member. A first spring disposed in the upper chamber interconnects the hand grip assembly with a flange on the upper portion of the tool drive housing, while a second spring disposed in the lower housing interconnects the hand grip assembly with the weighted ring. The characteristic frequency of the subsystem including the second spring and the weighted ring is chosen to be equal to the normal impact frequency of the tool when the latter is in operation.

4 Claims, 1 Drawing Figure

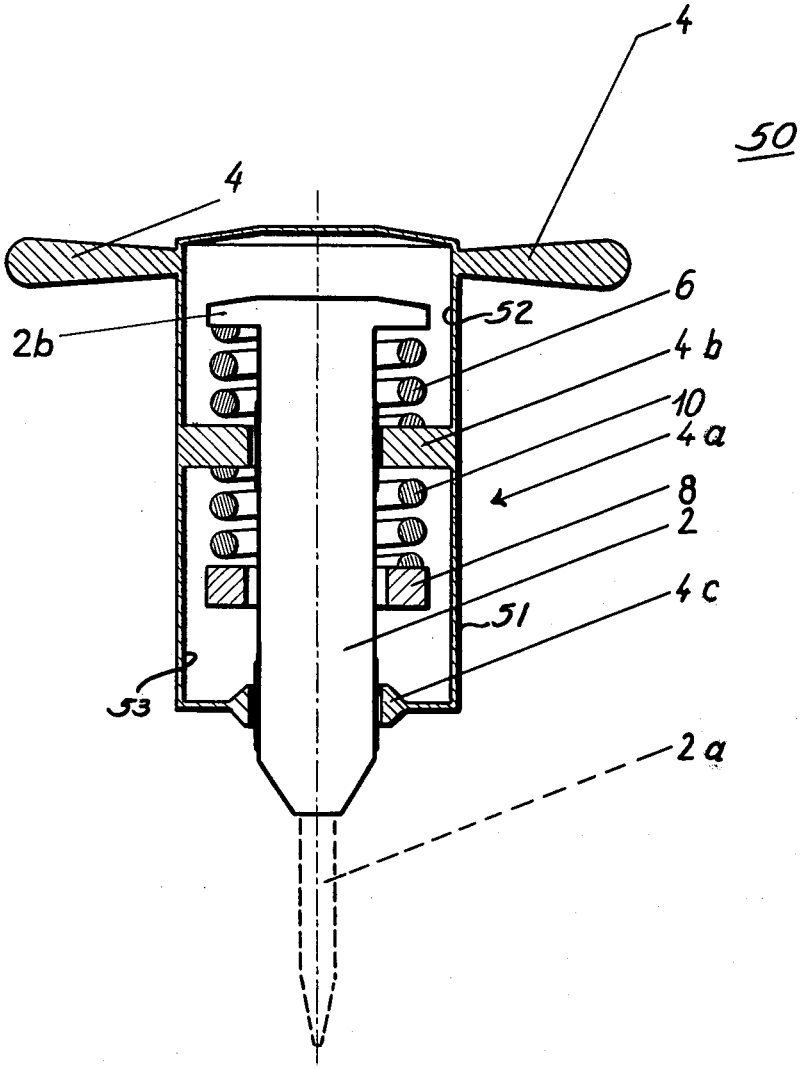
4
50
4
6
52
2b
4 b
10
4 a
8
2
4 c
51
53
2 a

POWER-DRIVEN IMPACT TOOL HAVING AN IMPACT-RESISTANT HAND GRIP ASSEMBLY

BACKGROUND OF THE INVENTION

Conventional power-driven impact tools, such as pneumatic hammers and boring tools, are spring-coupled to a surrounding hand grip assembly which has, on its upper end, a hand piece which is grasped by the tool operator. As is well known, unless suitable facilities are provided between the tool drive housing and the hand grip assembly, the strong vibratory forces generated by the tool via impact and shaking movements thereof are transmitted directly to the operator's body via the hand grip assembly. To avoid the obvious dangers thereof, various schemes have been proposed in the past to minimize the transmission of such vibrations.

In one suggested scheme, such vibrations are reduced by significantly increasing the mass of the hand grip assembly and/or providing a very soft spring between the tool drive housing and the hand grip assembly. Such construction, unfortunately, is too heavy and bulky for practical applications.

In another proposed scheme, suitable damping members are introduced in the mechanical circuit between the tool drive housing and the hand grip assembly. Such scheme has suffered from the fact that the introduction of such resistive damping itself sets up accompanying forces that prevent the attainment of the desired goal of isolating the hand grip assembly from the impact portion of the device.

SUMMARY OF THE INVENTION

The present invention provides an improved power-driven impact tool assembly which substantially protects the operator from impacts and shaking motions generated by the tool in operation while avoiding the above-mentioned disadvantages.

In an illustrative embodiment, the hand grip assembly is formed as a cylindrical shell having an intermediate, inwardly extending first guide member that divides the shell into upper and lower chambers. A first spring that provides axial movement between the hand grip assembly and the tool drive housing is disposed in the upper portion of the chamber. A second spring is terminated by a weighted ring in the lower chamber, such second spring extending downwardly from the first guide member to support the weighted ring in coaxial surrounding relation with the tool drive housing and for limited axial movement with respect thereto.

The characteristic frequency of the subsystem defined by the second spring and the weighted ring inside the lower chamber is chosen to be equal to the normal impact frequency of the tool during operation.

Preferably, a second annular guide member is disposed at the lower end of the hand grip assembly, and extends inwardly to terminate adjacent the periphery of the tool drive housing to define the lower boundary of the lower chamber.

Additionally, the spring constant of a first spring in the upper chamber and the mass of the hand grip assembly are chosen with respect to the spring constant of the second spring and the mass of the weighted ring so that the overall characteristic resonant frequencies of the tool are significantly separated from the normal impact frequency of the tool during operation.

BRIEF DESCRIPTION OF THE DRAWING

The invention is further set forth in the following detailed description taken in conjunction with the appended drawing, in which the single FIGURE illustrates in longitudinal section a power-driven impact tool having facilities in accordance with the invention for isolating the tool operator from vibratory forces set up during tool operation.

DETAILED DESCRIPTION

Referring now to the drawing, a power-driven, impact-type tool designated by the numeral 50 is provided with a conventional, elongated tool housing 2 at the lower end of which a conventional drive element 2a (such as a hammer or boring head) is disposed. A flange 2b is disposed at the upper end of the housing 2.

A hand grip assembly **4*a* is disposed coaxially around the tool drive housing 2 for limited axial movement with respect thereto. The upper portion of the hand grip assembly is equipped with hand grips 4-4,** which may be conventionally grasped by a tool operator.

The tool 50 is provided with facilities for substantially insultating the hand grips 4, and thereby the operator, from harmful impacts and shocks generated by the tool **2*a* during operation. In accordance with the invention, such facilities are provided in an inexpensive and streamlined way by incorporating a weighted ring 8 in coaxial surrounding relation with the tool drive housing 2, the weighted ring 8 being carried for limited axial movement with respect to the housing 2 and with respect to the hand grip assembly 4*a* by means of a spring 10. The spring constant of the spring 10 and the mass of the weighted ring 8 are chosen such that the characteristic resonant frequency of the subsystem defined thereby is equal to the impact frequency of the tool during operation, thereby effectively canceling the component of shock and vibration which would normally transmitted from the tool head 2*a* to the hand grips 4. As shown in the FIGURE, the hand grip assembly 4*a* is embodied as a cylindrical shell 51 which is disposed in surrounding relation to the housing 2.**

The shell 51 includes a first annular guide member **4*b* which is disposed intermediate the ends of the shell and which extends radially inwardly from the shell periphery to terminate adjacent the outer periphery of the housing 2. The guide member 4*b* divides the interior of the shell 51 into upper and lower chamber 52 and 53,** respectively.

In order to effect limited axial movement between the hand grip assembly **4*a* and the tool housing 2, a spring 6 is disposed between the upper surface of the guide member 4*b* and the lower surface of the flange 2*b* on the upper end of the housing 2.**

The weighted ring 8 and the associated spring 10 are disposed in the lower chamber 53. In particular, an upper end of the spring 10 is carried on the lower surface of the guide member **4*b*, and the lower end of the spring 10 is affixed to the upper surface of the weighted ring 8.**

The above-described construction provides a compact, inexpensive and functionally effective mechanism for eliminating deleterious transmissions of vibrations and shocks from the tool head **2*a* to the operator's body via the hand grips 4. Preferably, an improved operation of the overall apparatus is obtained if in addition to designing the resonant frequency of the spring 10 and weighted ring 8 as indicated above, the spring constant of the spring 6 and the mass of the overall hand grip assembly 4***a* are chosen, relative to their counterparts in the spring 10 and the weighted ring 8, so that the characteristic resonant frequencies of the overall tool 50 are far removed from the normal impact frequency of the tool 2*a* during tool operation.

The lower portion of the lower chamber 53 is bounded by a second annular guide member 4*c* of the cylindrical shell 51. Like the first guide member 4*b*, the lower guide member 4*c* extends radially inwardly from the periphery of the shell 51 to coaxially surround the outer periphery of the tool housing 2.

In the foregoing, the invention has been described in connection with one illustrative arrangement thereof. Many variations and modifications will now occur to those skilled in the art. It is accordingly desired that the scope of the appended claims not be limited to the specific disclosure herein-contained.

What is claimed:

1. In a power-driven impact tool including an elongated tool drive housing having a flange at its upper end and adapted to receive at its lower end a drive member operative at a predetermined first frequency, and a hand grip assembly coupled to the tool drive housing via a first spring for axial movement with respect to the tool drive housing, the hand grip assembly having at its upper end a hand piece adapted to be grasped by a tool operator, the improvement which comprises, in combination, a second spring surrounding the tool drive housing and having one end carried by the hand grip assembly, and a weighted ring surrounding the tool drive housing and affixed to the other end of the second spring, the characteristic frequency of the subsystem defined by the second spring and the weighted ring being chosen to be equal to the first frequency, whereby the hand piece is substantially isolated from impacts and shaking movements set up by the drive member when the latter is operative.

2. A tool as defined in claim 1, in which the hand grip assembly comprises a cylindrical shell disposed coaxially around the tool drive housing and having a first annular guide member disposed intermediate its ends, the first guide member extending inwardly to terminate adjacent the outer periphery of the tool drive housing to define upper and lower chambers within the cylindrical shell, the first spring being disposed within the upper chamber and extending between the first guide member and the flange of the tool drive housing; and in which the second spring and the weighted ring are each disposed within the lower chamber, the second spring extending downwardly from the first guide member to engage the upper surface of the weighted ring.

3. A tool as defined in claim 1, in which the hand grip assembly further comprises a second annular guide member disposed at the lower end of the cylindrical shell and extending inwardly to terminate adjacent the outer periphery of the tool drive housing, the second guide member forming the lower boundary of the lower chamber.

4. A tool as defined in claim 1, in which the spring constant of the first spring and the mass of the hand grip assembly are chosen relative to the spring constant of the second spring and the mass of the weighted ring so that the overall characteristic resonant frequencies of the tool are significantly separated from the first frequency.

* * * * *